US005819943A

United States Patent [19]

Depuy

[11] Patent Number: 5,819,943

[45] Date of Patent: Oct. 13, 1998

[54] INFLATABLE EXTERNAL AIR CUSHION ASSEMBLY AND CARGO CRATE BEARING THE SAME

[76] Inventor: Clyde A. Depuy, 154 Meadow La., Springfield, Ohio 45505

[21] Appl. No.: 958,046

[22] Filed: Oct. 27, 1997

[51] Int. Cl.[6] ..... B65D 81/02; B65D 30/24; B60P 1/64; B61P 45/00

[52] U.S. Cl. ..... 206/522; 206/522; 206/386; 410/87; 410/88; 410/119; 410/125; 383/3

[58] Field of Search ..... 206/522, 386; 383/3; 410/87, 88, 119, 125; 248/631

[56] References Cited

U.S. PATENT DOCUMENTS 3,145,853 8/1964 Langenberg .
3,199,689 8/1965 Feldkamp .
3,392,800 7/1968 Swamy .
3,462,027 8/1969 Puckhaber .
3,466,010 9/1969 Jung .
3,513,934 5/1970 Crowley .
3,578,050 5/1971 Weingarten et al. .
3,847,091 11/1974 Holt .
4,905,835 3/1990 Pivert et al. .
5,275,290 1/1994 Bierfreund .
5,351,829 10/1994 Batsford .

*Primary Examiner*—Paul T. Sewell
*Assistant Examiner*—Jila Mohandesi
*Attorney, Agent, or Firm*—Richard C. Litman

[57] ABSTRACT

An air cushion assembly made up of a prefabricated air bag with a rubber air bladder secured between opposed circular metal plates, a rectangular backing member secured to one of the opposed circular plates, a pair of rigid U-shaped members secured to the other of the opposed circular plates, and an inflating valve and hose positioned between the rigid members. The air cushion assemblies are particularly disposed for use in connection with a cargo crate of the type intended to be shipped in sea cargo containers. The cargo crates bearing the air cushion assemblies have a plurality of the assemblies spaced apart and connected to the bottom of the crate through the pair of rigid members, and at least one of the assemblies connected through the backing member to each of the side walls. The inflation hoses preferably are all extended to one of the sidewalls to facilitate the variable inflation of the air cushion assemblies and consequent proper leveling of the crate following insertion of the cargo crate into a sea cargo container.

18 Claims, 4 Drawing Sheets

INFLATABLE EXTERNAL AIR CUSHION ASSEMBLY AND CARGO CRATE BEARING THE SAME

BACKGROUND OF THE INVENTION

1. Field of the Invention

The present invention relates to external air cushion assemblies for use with packaging containers to protect the contents thereof. In particular, the packaging cushions are attached to the external sides of a cargo crate to protect the contents thereof against shock during transport. Multiple cargo crates equipped with the external cushion assemblies can be housed in sea cargo containers.

2. Description of the Relative Art

Since the beginning of long-distance transportation of goods, whether by road, rail, sea or air, shippers and common carriers of goods have sought materials and packaging methods which would minimize or eliminate damage to the shipped goods. Although numerous materials and methods have been developed, it is of particular concern that the packaged product be provided sufficient protection against the most potentially damaging mode of transportation. For instance, it would not normally be prudent for a shipper to transport fragile cargo by sea because sea travel normally tends to be much rougher than air, road or rail travel. This, however, presents a dilemma for the intercontinental shipper of fragile goods which are not time sensitive. Since the road and rail transportation are not available, the only remaining options are transportation via air or sea.

Air transportation clearly is more time-efficient and typically is less hazardous to the fragile cargo. Air transportation, however, is considerably more expensive than sea transportation. For example, the cost for air transportation to a particular destination is approximately $26, 000, whereas the cost for sea transportation of the same cargo to the same destination is only $8,000. The change in modes of transportation results in a substantial net saving of several thousands of dollars per shipment. Thus, where time is not critical, it would be financially beneficial to provide sea transportation of such goods where the packaging materials and methods employed are sufficient to protect the fragile cargo from the rough and abusive nature of sea travel. There is a great need, therefore, to provide packaging materials and packaging methods which afford a shipper of goods the freedom to utilize whichever mode of shipment provides the shipper with the greatest margin of profit.

The relevant art contains various types of packaging materials and methods. One type of supplemental device is the inflatable dunnage. Dunnage devices typically are used to provide supplemental support for the shipping containers by filling space between adjacent containers as well as between the containers and the walls of the shipping vessel. The dunnage devices may be attached to the inside walls of the shipping vessel, or they may also take the form of separate devices placed between individual cartons. Regardless of their form, dunnage devices prevent load shifting and the subsequent crushing of cargo, but at the expense of occupying valuable space available within the shipping vessel.

Exemplary dunnage devices are those described in U.S. Pat. No. 3,145,853, which issued to Frederick G. Langenberg on Aug. 25, 1964; U.S. Pat. No. 3,199,689, which issued to John G. Feldkamp on Aug. 10, 1965; U.S. Pat. No. 3,462,027, which issued to Edmund C. Puckhaber on Aug. 19, 1969; and U.S. Pat. No. 3,847,091, which issued to Jan D. Holt on Nov. 12, 1974.

In addition to the use of dunnage devices, individual containers may be equipped with inflatable cushions inserted between the walls of the container and the contents. Such inflatable cushion inserts provide a buffer space between the container walls and the fragile contents, as well as reduce the shock transmitted to the contents of the container. The relative art describes numerous inflatable cushions that are inserted in containers. Exemplary inflatable cushions are disclosed in U.S. Pat. No. 4,905,835, which issued to Alain Pivert et al. on Mar. 6, 1990, and U.S. Pat. No. 5,351,829, which issued to Charles A. Batsford on Oct. 4, 1994.

Another inflatable container element is described in U.S. Pat. No. 3,578,050, which issued to Joseph L. Weingarten et al. on May 11, 1971. The Weingarten et al. container is a collapsible air cargo container that has a plurality of connected inflatable walls that are hingedly attached to a lower pallet. The inflatable walls, while providing some additional protection for the contents of the air cargo container, are primarily designed for inflation and deflation as necessary to conserve space in a cargo plane. Although the inflatable walls are semi-rigid, a plurality of individual straps are necessary to conform the walls to the contents therein. This results in time consuming adjustments necessary to protect against shifting of the container contents during transport.

Yet another container having inflatable elements is described in U.S. Pat. No. 5,275,290, which issued to Karl-Heinz Bierfreund on Jan. 4, 1994. The Bierfreund container has spaced double-shell walls with a single inflatable cushion internal to the inner walls. The inflatable cushion has a number of communicating compartments, which are equal in number to the sides of the container. The air bag compartments may be inflated to conform to the structure of the container contents, which prevents the contents from shifting inside the container during transport. By flexing inwardly or outwardly in response to the pressure applied against it, the inner wall provides some freedom for the inflatable cushion to expand or contract with temperature and pressure changes. However, the conforming feature of the air bags increases the risk of puncture and distinguishes the teachings this patent from the instant invention.

Air cushion pallets, or air cushion transports, provide another example of inflatable cushions used in connection with the transportation of materials. Air cushion pallets have a plurality of inflatable cushions that individually or collectively communicate with a pressurized air source during use. Each of the air cushions is provided with a plurality of small openings in their lower sides that allow for escape of the pressurized air, which produces a film of air for frictionless transport of the pallet. Exemplary air cushion pallets are described in U.S. Pat. No. 3,392,800, which issued to Venkat K. Swamy on Jul. 16, 1968; U.S. Pat. No. 3,466,010, which issued to Richard R. Jung on Sep. 9, 1969; and U.S. Pat. No. 3,513,934, which issued to Walter A. Crowley on May 26, 1970. Air cushion pallets of the type described above, while unrelated to the present invention, utilize similar arrangements of the air cushions.

Because of the design of the various air cushions and dunnage, they are not particularly well suited for use with heavy contents, for example, with objects having a weight of up to ten tons. Furthermore, because of the substantial weight that may be involved, the air cushions and dunnage are susceptible to puncture. Therefore, there also is a need for packaging materials and methods which are adequate to protect contents fragile in design but also having substantial weight, i.e., up to ten tons.

None of the above inventions and patents, taken either singly or in combination, is seen to describe the instant invention as claimed.

SUMMARY OF THE INVENTION

The air cushion assembly of the present invention comprises a prefabricated air bag of the type having an air bladder secured by molding between a pair of opposed circular plates, a rectangular backing member secured to the bottom or rear circular plate, and a pair of rigid U-shaped or channel members aligned in parallel and secured along their backs to the top or front circular plate. Intermediate the U-shaped members is the air inlet valve for inflating the air bag, and coupled to the air inlet valve is a hose which allows for remote inflation of the air bags. The backing member and the U-shaped members preferably are secured to the opposed plates on the air bag using bolts in threaded blind bores.

A cargo crate of the present invention utilizes the above-described air cushion assemblies. The cargo crate is formed conventionally of an internal wooden framework having overlaid plywood sheets. Each side of the crate is fastened to the other side, and additional support is provided by retaining bands tightly wound about the perimeter of the crate. Depending upon the size of the crate, a plurality (preferably four) of air cushion assemblies are secured to the lower side of a pallet supporting the crate arranged in uniformly spaced relationship to one another. Bolts secure the rigid U-shaped members to the bottom of the crate, with the backing members providing the foundation for supporting the crate following inflation of the air cushion assemblies. The rectangular backing members of each deflated air cushion assembly enable rapid deployment underneath the crate and between the runner beams of the pallet and inflation of the air cushion assemblies for lifting the pallet slightly off the floor. Attached centrally to each side wall and to the top of the crate is a single air bag, with the backing member secured to the plywood and the U-shaped members projecting outwardly. The hoses pass to one side of the crate, and preferably the side which will remain accessible following insertion of the crate into a sea cargo container. By running the hoses to one side of the crate, each of the air cushion assemblies may more easily be inflated and the crate leveled following insertion into the container. Furthermore, it is easier to insert the cargo crate, such as by a forklift, into a sea cargo container.

The cargo crates utilizing the air cushion assemblies may accommodate contents having a weight of up to ten tons, and the cargo crates have been found to adequately protect the fragile contents against damage from shock which could result during their transportation in sea cargo containers.

Accordingly, it is a principal object of the invention to provide a air cushion assembly disposed for use with heavy weight cargo crates.

It is another object of the invention to provide a cargo crate that protects fragile yet heavy weight contents during transportation of the contents.

It is a further object of the invention to provide a cargo crate that will allow a shipper of fragile contents to maximize profits by shipping fragile contents via sea rather than air.

Yet another object of the invention is to provide air cushion assemblies placed at strategic points on each crate for encasement in sea cargo containers.

It is an object of the invention to provide improved elements and arrangements thereof in an apparatus and a method for using said apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
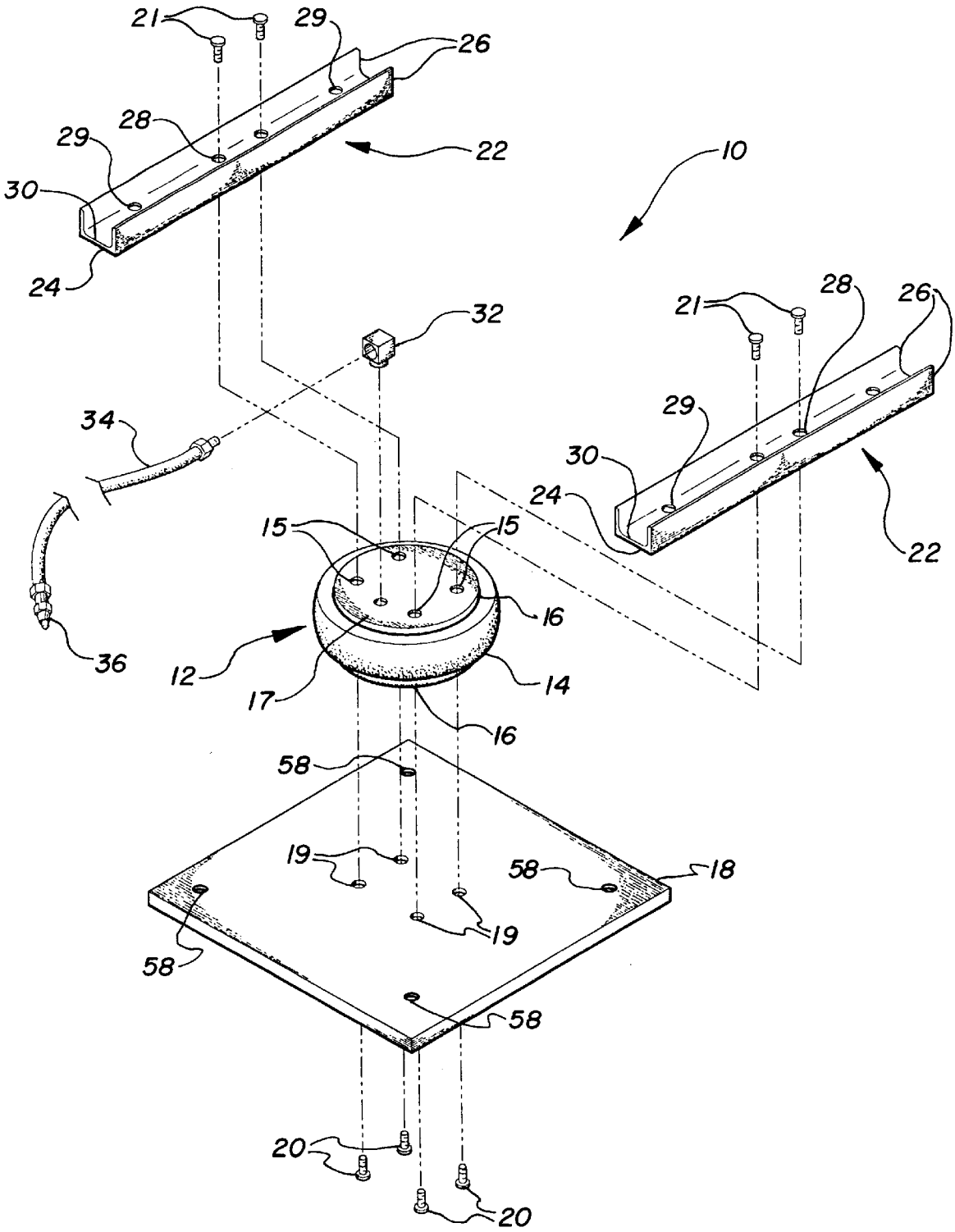
FIG. 1 is an exploded perspective view of an individual air cushion assembly prepared according to the present invention.

In FIG. 1, air cushion assembly 10 comprises a prefabricated air bag 12 which has a resilient air bladder 14 with a valve stem (not shown) mechanically secured by the valve stem and sealed between a pair of opposed, i.e., top and bottom, circular metal plates 16. The air bladder 14 is made of rubber and is molded with the plates 16 to form a sealed unit. Secured to one side of the air bag 12 is a rigid planar, rectangular or square, backing member 18 that is used for mounting the air cushion assembly 10 to the sides of a cargo crate 40 shown in FIG. 2 or for supporting the weight of the assembled cargo crate 40 as shown in FIG. 3. Preferably the backing member 18 is formed of a rectangular piece of steel or other strong metal for positioning between runners 48 of a pallet 50. The rigid backing member 18 is secured to the circular metal plate 16 (having four threaded blind bores 15) on the bottom of the air bag 12 by bolts 20 or the like which pass through aligned smooth throughbores 19 in the backing member 18.

Secured to the top of the air bag 12 are a pair of rigid U-shaped or channel members 22. Preferably the U-shaped members 22 are formed of steel or an equivalent strong metal. In FIG. 1, each U-shaped member 22 has a flat back portion 24 with a pair of parallel flanges 26 to define a channel 30. The back portion 24 is provided with a first inner pair of threaded blind bores 28 through which bolts 21 can secure the U-shaped member 22 to the circular metal plate 16 of the air bag 12. The U-shaped members 22 are secured to the air bag 12 so that they are aligned in spaced, parallel relation to one another. This configuration ensures a more stable support base when the air cushion assembly 10 is used on the bottom of a cargo crate 40. Like the bolts 20 which secure together the backing member 18 and the air bag 12, the bolts 21 are used to secure together the U-shaped members 22 and the air bag 12.

It should be apparent from FIG. 1 that the construction of the air cushion assembly 10 affords protection against puncturing of the air bag 12. The rigid backing member 18 protects one entire side or rear of the air bag 12, and the U-shaped members 22 make it difficult for a foreign object to contact the air bag 12. Thus, in addition to providing a stable base for supporting a cargo crate 40, the backing member 18 and the U-shaped members 22 provide substantial protection against disruption of the air bags 12.

Figure 4:
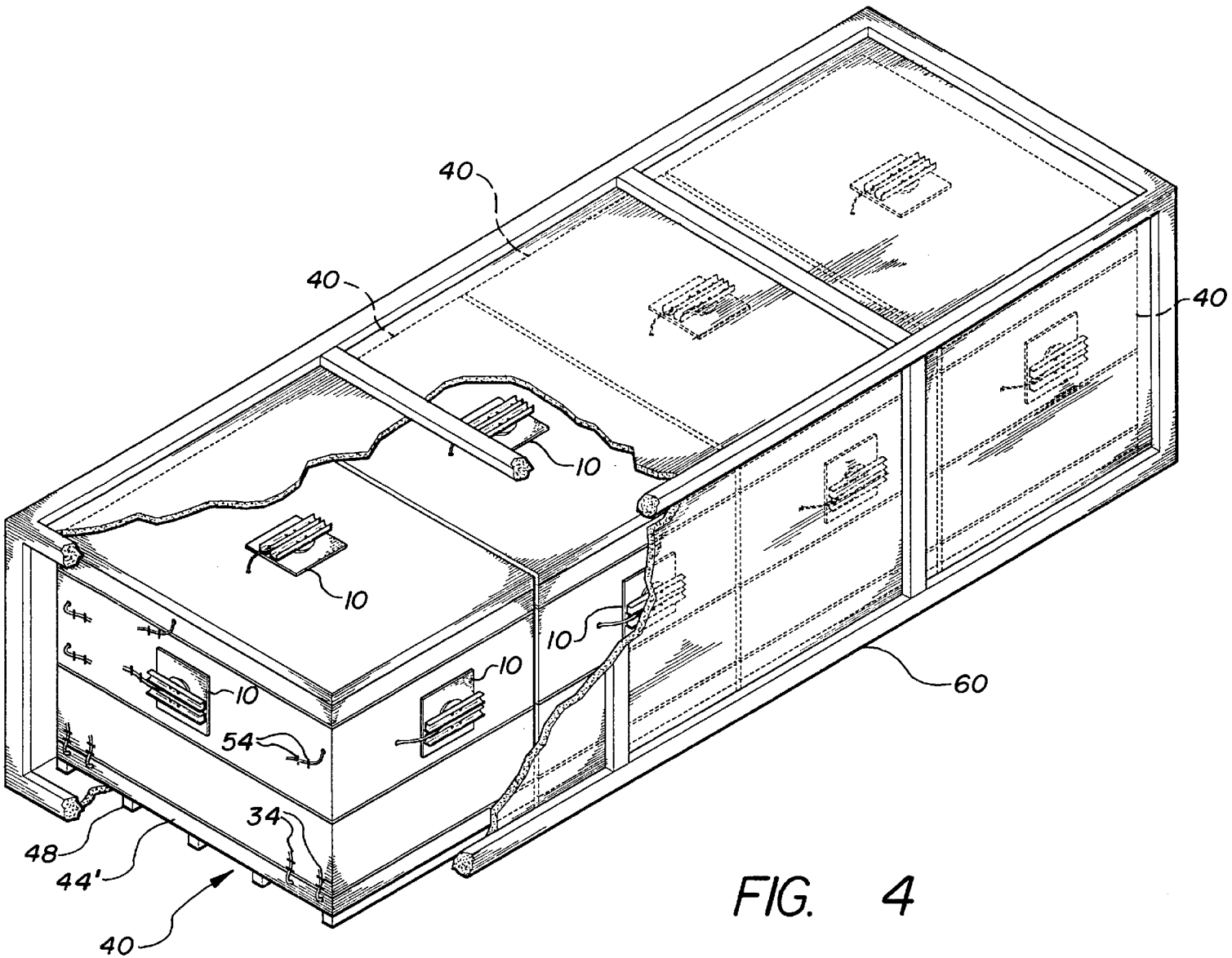
FIG. 4 is an environmental view partially broken away of a sea cargo container filled with four cargo crates prepared according to the present invention.

Between the U-shaped members 22 is a valve 32 which passes through a threaded throughbore 17 of the metal plate 16 upon which it is secured and communicates with the air bladder 14 for inflation and deflation of the air bag 12. A hose 34 has one end thereof connected to valve 32 and the other end thereof connected to a coupling 36. The end of hose 34 having the coupling 36 can be used for remote inflation of the air bag 12 following the insertion of an assembled cargo crate 40 into a conventional sea cargo container 60, as discussed above and seen in FIG. 4.

Figure 2:
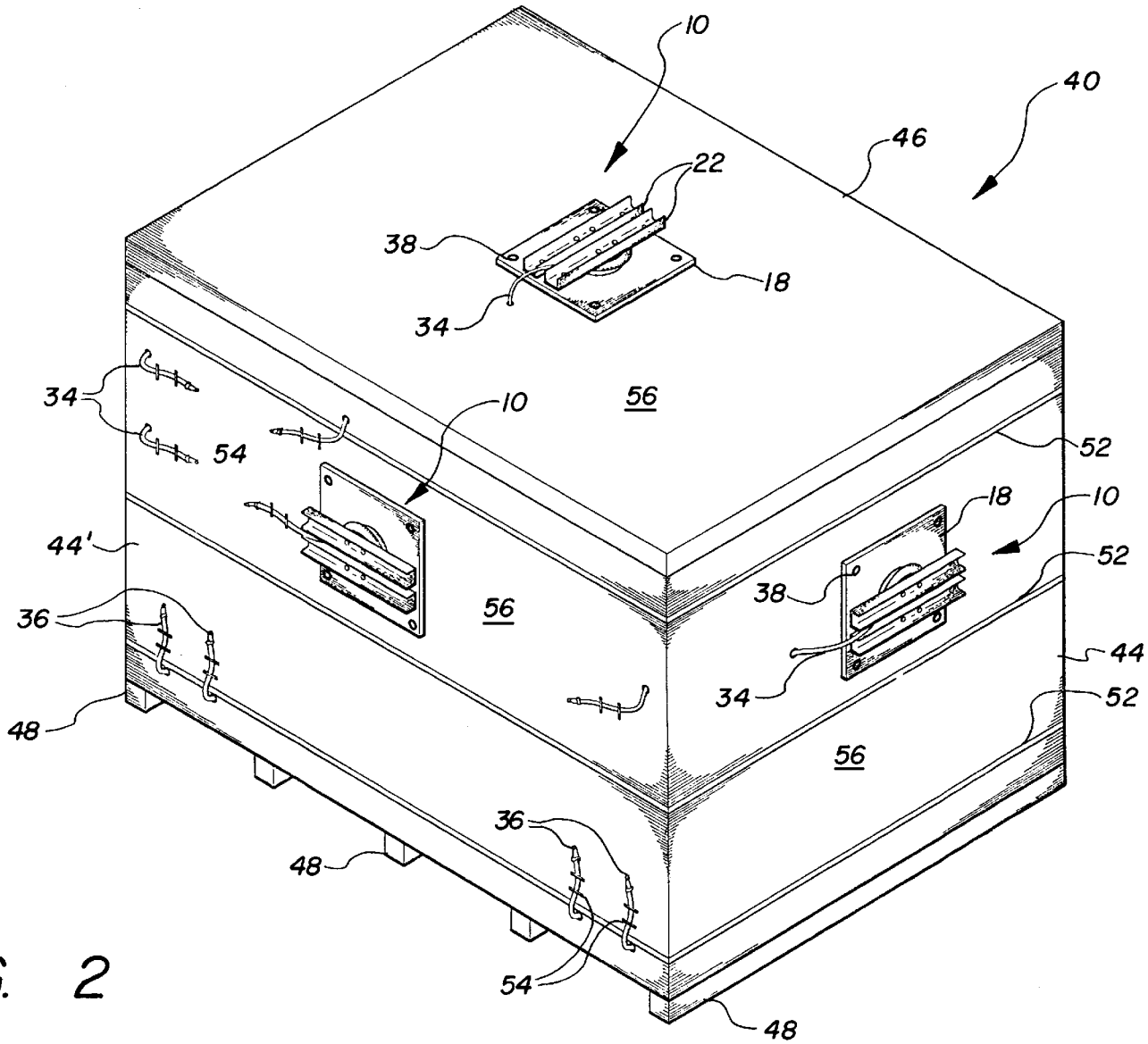
FIG. 2 is a perspective view of a cargo crate assembled according to the present invention, with individual air cushion assemblies mounted centrally of each of the four exposed sides (only three sides shown) and top, and all air hoses positioned on a single side of the crate.
Figure 3:
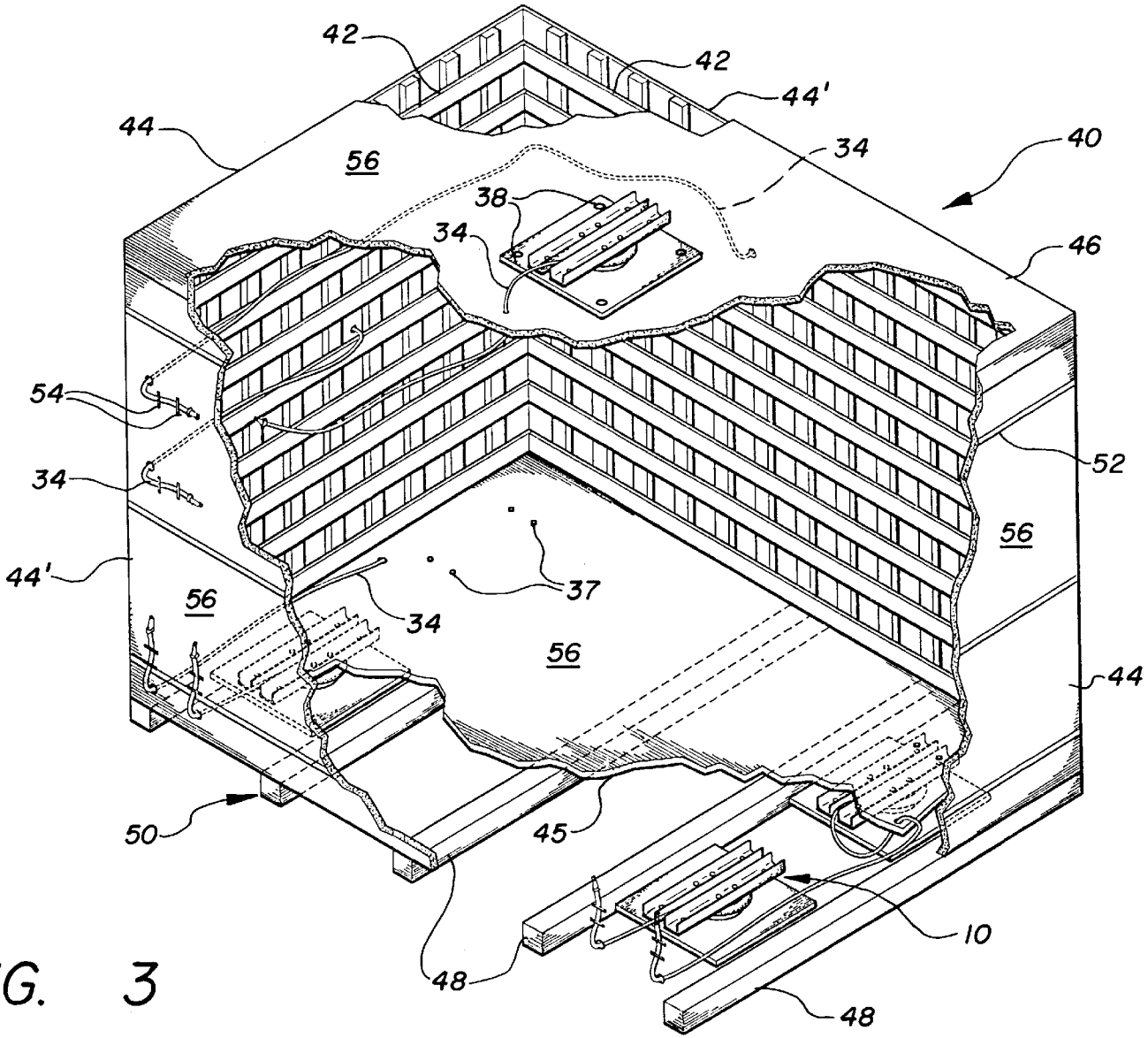
FIG. 3 is a perspective view of a cargo crate, with the side walls partially broken away to expose the internal framework of the crate and the air hoses passing through the interior of the crate, wherein a portion of the bottom side is broken away to expose three of the four air cushion assemblies bolted beneath.

Referring now to FIGS. 2 and 3, cargo crate 40 is provided with a plurality of air cushion assemblies 10. The cargo crate 40 has a bottom side 45, left and right sidewalls 44, front and rear sidewalls 44', and a top side 46. Each side wall 44, 44' and the top side 46 of the cargo crate 40 is formed with an internal wooden framework 42 (FIG. 3) which is overlaid on its exterior by a layer of sheet plywood 56. The bottom 45 is also sheet plywood 56. Preferably, the internal framework 42 is assembled with relatively strong pieces of wood, i.e., 2×4's, 2×6's, 4×4's, etc. Following the assembly of the cargo crate 40, the sidewalls 44, 44' are further supported by the presence of a number of steel bands 52 or the like which are tightened about the perimeter of the crate 40 and crimped in place. Although not shown, additional corner supports may also be provided to help maintain the integrity of the cargo crate 40. The bottom 45 of the crate 40 is further provided with five parallel and equally spaced wooden beams 48, which separate and space apart the air cushion assemblies 10 mounted thereon.

As shown in FIG. 3, four air cushion assemblies 10 (although one assembly is not shown except for the four attachment bolts 37) are provided at the bottom at each corner of the cargo crate 40 so that each assembly 10 will bear approximately an equivalent load. It should be apparent that where larger pieces of cargo are concerned, it will be necessary to utilize a larger cargo crate and, perhaps, a greater number of air cushion assemblies 10.

In FIG. 3, the bottom 45 of the cargo crate 40 is shown with the four air cushion assemblies 10 mounted adjacent each of the four corners of the crate 40. Each air cushion assembly 10 is secured to the bottom 45 by bolts 37 which connect the U-shaped member 22 thereon to the bottom side. The U-shaped members 22 are positioned so that the flanges 26 thereon physically embed or otherwise engage the bottom 45 when the bolts 37 are used to tighten the connection between each assembly 10 and the cargo crate 40. To facilitate the connection between the cargo crate 40 and the U-shaped members 22, a second pair of holes 29 (FIG. 1) are provided proximate the ends of each U-shaped member 22. With the U-shaped members 22 connected to the bottom side of the cargo crate 40, the backing members 18 of each assembly 10 extend below the height of beams 48 to support the cargo crate 40 as it rests on the ground or another surface. Although not shown in FIG. 3, additional structural support can be provided for the bottom 45 by including coverage of the internal wooden framework 42 onto the floor or bottom 45 of the cargo crate 40. For purposes of clarity in drawing the connection of air cushion assemblies 10 to the bottom 45, however, no such internal framework was shown.

Referring again to FIGS. 2 and 3, mounted centrally and externally of each side wall 44, 44' is a single air cushion assembly 10, which is anchored to the plywood sheets 56 and the internal framework 42 by four bolts 38 that pass through the threaded throughbores 58 in the corners of the backing member 18. While it is not necessary, a single air cushion assembly 10 can be optionally mounted externally and centrally of the top 46 of the cargo crate 40. Where a larger cargo crate 40 is assembled, it also may be necessary to provide each sidewall 44, 44' with more than one air cushion assembly 10 to ensure protection of the cargo. Each air cushion assembly 10 is oriented with its U-shaped members 22 positioned outwardly for contacting any surface, i.e., vessel wall, another crate, etc., adjacent the cargo crate 40.

As shown in FIGS. 2 and 3, each of the hoses 34 (connected to a single air cushion assembly 10) can be routed to one side wall 44' (front) and be secured with the coupling 36 in an easily accessible position. It is preferable to run all the hoses 34 to one side wall 44', because such an arrangement facilitates the inflation of all air cushion assemblies 10 without the need to walk around the cargo crate 40. Furthermore, because all hoses 34 are routed to one sidewall, and preferably the sidewall which may remain visible following insertion of the cargo crate into a sea cargo container 60, all of the air cushion assemblies 10 can be inflated after inserting the cargo crate into the sea cargo container 60. This facilitates easier insertion into the sea cargo container (due to greater height clearance) by a forklift, as well as a more simplified task for regulating the pressure within each air cushion assembly 10 and leveling the cargo crate 40. To avoid damage to the hoses 34 during handling of the cargo crate 40, it is preferable to run the hoses 34 through the interior of the crate 40. When running the hoses 34 through the interior of the crate 40, the hoses are secured to the internal framework 42 using carpentry staples 54 or the like fasteners.

In assembling the cargo crate 40, pre-assembled sides 44, 44', 45, and 46 are built according to specific dimensions that are determined by the size of the sea cargo container 60 and the size of the cargo, and later secured together. Then the air cushion assemblies 10 are secured to their appropriate positions on the bottom side 45. If an internal wooden framework 42 is provided on the bottom 45 of the cargo crate 40, then the U-shaped members 22 on each air cushion assembly 10 will be secured to the internal framework 42 by bolts 37. Holes drilled through the internal framework 42 facilitate mounting of the air cushion assemblies 10. Additional holes are drilled through the bottom wall 45 to allow hoses 34 to pass into the interior of the crate 40. However, the hoses 34 for each of the bottom air cushion assemblies 10 should not be stapled in place until the cargo is secured in position.

With the bottom wall 45 placed upright in its proper position, the cargo may be positioned by a forklift or the like so that it is located centrally of the bottom wall 45. If possible, the cargo should then be anchored to the bottom wall 45 to prevent any shifting of the cargo during shipment. For example, wooden studs (not shown) can be mounted onto the feet of a piece of heavy machinery, and those studs can be removably secured to the pallet 50 through the bottom wall 45.

With the cargo properly positioned and secured to the bottom wall 45, the prefabricated sidewalls 44, 44' of the crate are next be assembled around the cargo and removably secured together by bolts, screws or the like. To a generally central location on the exterior of each side wall 44, 44', a single air cushion assembly 10 is mounted using bolts 38 to secure the rigid backing member 18 to the internal framework 42. Preferably a single air cushion assembly 10 will be used for each wall 44, 44'. However, more than one air cushion assembly 10 can be used if a wall is sufficiently large enough to warrant the additional protection. As before with the bottom wall 45, holes drilled through the internal framework 42 will ensure secure mounting of the air cushion assemblies 10. Likewise, additional holes are drilled through each side wall 44, 44' to allow hoses 34 to pass through to the interior of the crate 40 and out to the front sidewall 44'. The hoses 34 can be retained against each wall using, for example, conventional staples 54 fired from a staple gun (not shown).

When all of the sidewalls 44, 44' of the cargo crate have been assembled, and each of the air cushion assemblies 10 secured to the sidewalls, the prefabricated top wall 46 is secured to the crate 40. In the event the top wall 46 contains an air cushion assembly 10, then the hose 34 will pass through to the interior of the crate 40, retained against the internal framework 42 of the top wall, and pass through a hole in the front side wall 44'. The top 46 can be removably secured to the sidewalls 44, 44' using bolts, screws or the like. Securing the top wall 46 to the sidewalls 44, 44' completes the enclosure of the cargo, and now steel bands 52 are tightly wrapped around the perimeter of the crate 40 and crimped in place to provide additional support for the crate.

With the cargo crate 40 assembled and the air cushion assemblies 10 deflated, the crate is loaded into a sea cargo container 60 using a forklift tractor. After insertion into the sea cargo container 60, the air cushion assemblies 10 can be inflated by connecting the coupling 36 on each hose 34 to a pressurized air source such as an air pump. As previously indicated, this task is simplified by the presence of all hoses at the front side wall 44'. The air cushion assemblies 10 are inflated to various, appropriate pressures which serve to maintain the cargo crate 40 in a level position. For example, where the mass of the cargo is displaced from center so that one or more air cushion assemblies 10 bears significantly more weight than the others, it will be necessary to adjust the pressure in each of the bottom air cushion assemblies 10 so that the cargo crate 40 is maintained in a level position.

Due to the presence of the air cushion assemblies 10 on the exterior of the cargo crate 40, no two crates should directly contact one another. Instead, the air cushion assemblies 10 from adjacent cargo crates 40 either contact the adjacent crate or another air cushion assembly 10 from an adjacent crate. Regardless of which occurs, the air cushion assemblies 10 provide a buffer zone between adjacent cargo crates 40 to prevent contact between the crates. Furthermore, should any shock result from the effect of heavy seas, then the air cushion assemblies 10 will absorb some of the shock to prevent damage to the cargo.

It is to be understood that the present invention is not limited to the embodiments described above, but encompasses any and all embodiments within the scope of the following claims.

I claim:

1. An air cushion assembly for use on a cargo crate in the shipping of fragile and heavy cargo, the crate having side walls, a top wall and a bottom wall, said air cushion assembly comprising:

an air bag unit having an elastic air bladder being secured between a pair of opposed circular plates;

inflation means for inflating said air bag unit, said inflation means passing through one of said circular plates on said air bag unit;

a planar rectangular backing member being secured to one of said opposed plates, said backing member adapted for attachment to the cargo crate sidewalls and top wall; and a pair of spaced rigid U-shaped members being secured to the other of said opposed circular plates, said rigid U-shaped members being adapted for attachment to the bottom wall of the cargo crate, the cargo crate having a plurality of said attached air cushion assemblies distributed on its sidewalls, top wall and bottom wall, thereby providing safe shipping of fragile cargo in the cargo crate.

2. The air cushion assembly according to claim 1, said rigid U-shaped members being positioned in parallel and spaced relationship on said other of said opposed circular plates.

3. The air cushion assembly according to claim 1, said inflation means being positioned between said rigid U-shaped members.

4. The air cushion assembly according to claim 1, each of said rigid U-shaped members having a flat back region with two opposed parallel flanges extending from said back region to form a channel;

said back region on each of said rigid U-shaped members contacting the other of said circular plates on said air bag unit; and a plurality of threaded connectors, said rigid U-shaped members being secured to the other of said circular plates by said plurality of threaded connectors.

5. A cargo crate for shipping fragile and heavy cargo, comprising:

(a) a cargo crate having a top wall, a bottom wall, and four sidewalls;

(b) a plurality of air cushion assemblies, each of said air cushion assemblies comprising:

(1) an air bag unit having an elastic air bladder being secured between a pair of opposed circular plates;

(2) a planar rectangular backing member being secured to one of said opposed circular plates, said backing member being disposed for attachment to said sidewalls of the cargo crate;

(3) a pair of spaced rigid U-shaped members being secured to the other of said opposed circular plates, said rigid U-shaped members being disposed for attachment to said bottom wall of said cargo crate; and (4) inflation means for inflating said air bag unit, said inflation means passing through one of said circular plates on said air bag unit;

(c) each of said sidewalls of said crate having one of said air cushion assemblies secured thereon; and (d) said bottom wall of said crate having at least four of said air cushion assemblies secured thereon in spaced relationship to one another, said cargo crate providing safe shipping of fragile and heavy cargo.

6. The cargo crate according to claim 5, further including means for securing one of said air cushions to said top of said crate.

7. The cargo crate according to claim 5, further including means for securing four of said cushion assemblies to said bottom of said crate.

8. The cargo crate according to claim 5, wherein said inflation means comprise:

a valve secured in said one circular plate on said air bag unit, and communicating with said air bag unit for supplying air; and a hose having one end being secured to said valve, said hose having a coupling on the other end thereof.

9. The cargo crate according to claim 8, each said hose extending from one of said air cushion assemblies to a single sidewall on said cargo crate, and each said coupling on said hose being located on one sidewall of said crate.

10. The cargo crate according to claim 9, including a sea cargo container for containing a plurality of said cargo crates, said inflation hoses of each said cargo crate extending to one sidewall of said sea cargo container.

11. A method of shipping fragile and heavy cargo comprising the steps of:

(a) providing at least one crate for receiving fragile and heavy cargo, the crate having a top wall, a bottom wall, and four sidewalls;

(b) providing a plurality of air cushion assemblies, each of the air cushion assemblies comprising:

(1) an air bag unit having an elastic air bladder being secured between a pair of opposed circular plates;

(2) inflation means for inflating the air bag unit;

(3) a planar rectangular backing member being secured to one of the opposed plates; and (4) a pair of parallel spaced, rigid U-shaped members secured to the other of the opposed circular plates;

(c) attaching at least one of the air cushion assemblies to each of the four sidewalls on the crate, and attaching at least four air cushion assemblies to the bottom wall of the crate;

(d) inserting the crate into a larger transportation container for transport by sea; and (e) inflating the air bag in each of the air cushion assemblies for preventing damage to the crate inside the larger transportation container during transportation by sea.

12. The method according to claim 11, including the step of attaching one of the air cushion assemblies to the top wall of the crate.

13. The method according to claim 11, including the step of attaching the air cushion assembly to each sidewall by a plurality of bolts connecting each backing member together with the crate.

14. The method according to claim 11, including the step of attaching each of the four air cushion assemblies to the bottom wall of the crate by a plurality of bolts connecting the rigid U-shaped members together with the crate.

15. The method according to claim 11, including providing an inflation means by securing a valve in one of the circular plates on the air bag unit and communicating with the air bag unit, and securing a hose at one end to the valve and securing a coupling on the other end.

16. The method according to claim 15, including the step of extending each of the hoses from one of the air cushion assemblies to a single sidewall on the crate after attaching the air cushion assemblies to the sidewalls and prior to inserting the at least one crate into the larger transportation container.

17. The method according to claim 16, including the step of providing all of the couplings on each hose on a single sidewall of the crate.

18. The method according to claim 17, including the step of inserting the crate into the larger transportation container with the single sidewall upon which all of the couplings are accessible.

* * * * *